US006416565B1

(12) United States Patent
Yazawa et al.

(10) Patent No.: US 6,416,565 B1
(45) Date of Patent: Jul. 9, 2002

(54) METHOD FOR SMELTING COPPER SULFIDE CONCENTRATE

(75) Inventors: Akira Yazawa, Sendai; Yoichi Takeda, Morioka; Nozomu Hasegawa, Tokyo; Yoshiaki Mori, Hyuga, all of (JP)

(73) Assignees: Sumitomo Metal Mining Co., Ltd.; Mitsubishi Materials Corporation, both of (JP)

( * ) Notice: Subject to any disclaimer, the term of this patent is extended or adjusted under 35 U.S.C. 154(b) by 0 days.

(21) Appl. No.: 09/555,020

(22) PCT Filed: Aug. 11, 1999

(86) PCT No.: PCT/JP99/04350

§ 371 (c)(1),
(2), (4) Date: Oct. 5, 2000

(87) PCT Pub. No.: WO00/09772

PCT Pub. Date: Feb. 24, 2000

(30) Foreign Application Priority Data

Aug. 14, 1998 (JP) ..... 10-229803

(51) Int. Cl.[7] ..... C22B 15/00
(52) U.S. Cl. ..... 75/424; 75/643; 75/645
(58) Field of Search ..... 75/643, 641, 645, 75/424

(56) References Cited

U.S. PATENT DOCUMENTS 4,802,916 A * 2/1989 Victorovich et al. ..... 75/641
5,888,270 A * 3/1999 Edwards et al. ..... 75/643

FOREIGN PATENT DOCUMENTS

| | | |
|---|---|---|
| JP | 1-268823 | 10/1989 |
| JP | 1-268824 | 10/1989 |
| JP | 5-214460 | 8/1993 |
| JP | 10-147821 | 6/1998 |

* cited by examiner

*Primary Examiner*—Melvyn Andrews
(74) *Attorney, Agent, or Firm*—Finnegan, Henderson, Farabow, Garrett & Dunner, L.L.P.

(57) ABSTRACT

A method of oxygen-smelting copper sulfide concentrate to obtain white metal, nearly white metal matte or blister copper by removing most of the Fe in the copper sulfide concentrate into the slag as well as removing part or most of the S therein as $SO_2$ wherein oxygen-smelting is carried out to produce; slag in which a weight ratio of CaO to ($SiO_2$+CaO) is 0.3 to 0.6 and a weight ratio of Fe to (FeOx+$SiO_2$+CaO) is 0.2 to 0.5, and white metal, nearly white metal matte or blister copper, by adding $SiO_2$ material and CaO material to the copper sulfide concentrate as flux.

10 Claims, 5 Drawing Sheets

METHOD FOR SMELTING COPPER SULFIDE CONCENTRATE

FIELD OF THE INVENTION

The present invention relates to a pyrometallurgical process for copper smelting, and more particularly relates to a process for obtaining white metal or blister copper by oxygen smelting copper sulfide concentrate, or matte obtained from copper sulfide concentrate.

DESCRIPTION OF THE RELATED ART

Heretofore, copper smelting has comprised: a matte smelting process in which copper sulfide concentrate is oxygen smelted, part of the Fe in the ore is oxidized to be removed as slag, and part of the S becomes $SO_2$ so that Cu is concentrated into matte, being a mixture of FeS and $Cu_2S$; a subsequent white metal production process which obtains white metal ($Cu_2S$) containing almost no Fe, after removing Fe as slag with further oxidation of the obtained matte; and a copper production process which obtains blister copper by further oxidation of this white metal. An autogenous smelting furnace is generally used as the matte smelting furnace, while the white metal production process and the copper production process are usually carried out in a converter.

Since copper sulfide concentrate normally contains $SiO_2$ as gangue, the matte smelting process uses iron silicate slag. The converter also normally forms iron silicate slag by the addition of silica minerals as flux.

A matte smelting furnace produces matte, in which the copper content of the matte (matte grade; MG) is normally 70% or less by weight, and charges this into the converter. A converter, being a batch type, converts the matte into white metal, and subsequently into blister copper as described above. To increase the productivity of the whole plant, it is desirable to increase the MG in a matte smelting furnace and reduce the load in a batch type converter. If the matte smelting furnace can continue oxidization until white metal is produced, the white metal production process in the converter becomes unnecessary. Furthermore, if it can oxidize to blister copper, the converter process itself becomes unnecessary. However, if an attempt is made to increase the oxidation degree in the matte smelting furnace, the following problems caused by iron silicate slag occur.

(1) Magnetite Complications:

In iron silicate slag, the solubility of trivalent Fe is low. This causes so-called magnetite complications wherein solid magnetite is precipitated and deposited on the bottom of the furnace, and the like. To avoid this problem, in the case when MG is increased, the smelting temperature must be raised up to 1300° C. or more. However, this accelerates damage to the furnace body. Furthermore, when the copper content of the slag is increased by oxidizing part of the copper, even though iron silicate slag can produce blister copper without magnetite complications, the copper content of the slag in this case needs to be 25% or more and the yield of blister copper is considerably lowered.

(2) Oxidation and Dissolution of Copper:

As MG increases, the solubility of copper, as oxide, in iron silicate slag increases considerably.

(3) Concentration of Impurities:

In the presence of iron silicate slag and matte or blister copper, since the solubility of oxides of As, Sb and the like into iron silicate slag is low, these impurities concentrate into the matte or the blister copper. The effect is particularly high when iron silicate slag and blister copper coexist, and this is regarded to be one of the reasons why blister copper cannot be obtained directly from copper sulfide concentrate with high impurities in the presence of iron silicate slag.

From these points, a matte smelting furnace is normally operated with approximately 65 to 70% MG as the upper limit.

Furthermore, because of similar problems, in the process of oxidizing matte into low S content of blister copper, continuous processing is regarded to be impossible in the presence of iron silicate slag, and usually a batch process using a converter is carried out. There is a report (Japanese Unexamined Patent Publication No. Sho 58-224128) describing blister copper continuously obtained from matte in the presence of iron silicate slag. In this case, however, blister copper was obtained in the presence of three phases of slag, white metal and blister copper, and it was unavoidable for the S content of the blister copper thereof to be as high as 1.5%, increasing the load of the operation in the following process, a refining furnace, considerably.

Avoiding these problems, one of the inventors of the present invention has proposed a method to produce white metal in a matte smelting furnace in Japanese Examined Patent Publication No. Hei 5-15769. This is to remove iron in copper sulfide concentrate as calcium ferrite slag by adding lime as flux. There is an advantage in the use of calcium ferrite slag in that precipitation of magnetite is avoided and the elimination of impurities such as As, Sb or the like in the slag is higher than iron silicate slag. However, there are problems as described below.

(1) Copper sulfide concentrate normally contains some $SiO_2$. Therefore to produce as pure a calcium ferrite slag as possible, the copper sulfide concentrate to be processed is restricted to that with a low content of $SiO_2$ (3% or less).

(2) Even with copper sulfide concentrate with a low content of $SiO_2$ as mentioned above, if there is a little $SiO_2$ in the calcium ferrite slag, it worsens the viscosity and causes foaming, which renders it difficult to have a stable furnace operation. Therefore, when calcium ferrite slag is used, the content of $SiO_2$ in the slag should be regulated to be 1% or less (about 1.7% or less by weight with respect to Fe in the slag). In the case of obtaining white metal from standard copper sulfide concentrate mainly composed of chalcopyrite with this method, the $SiO_2$ content of the copper sulfide concentrate is restricted to 0.4% or less for practical purposes.

(3) Since the solubility of Pb into calcium ferrite slag is low, Pb is difficult to distribute into the slag, and becomes concentrated in the white metal.

(4) The amount of copper dissolving into the calcium ferrite slag as oxide is large, and the recovery percentage by concentration is low.

On the other hand, in a converter process, when matte is converted into white metal or blister copper by further oxidation, to avoid the problems caused by iron silicate slag, the process being in batches, the furnace temporarily stops blowing in the presence of white metal and slag and tilts to remove the slag, leaving only the white metal in the converter to oxidize into blister copper. This method, which has various drawbacks caused by the batch type process, makes the converter operation cumbersome. The Mitsubishi continuous copper smelting process avoids magnetite precipitation by using calcium ferrite slag in the process of a converter© furnace) and produces blister copper continuously from matte of approximately 65% MG. However, there are the following problems caused by calcium ferrite slag.

(1) The copper content of the slag changes continuously with respect to oxygen partial pressure, and as the S content of the blister copper is lowered, the copper content of the slag becomes higher. In practice, when the S content of the blister copper is approximately 0.5 to 1%, the Cu content of the slag is 13 to 15%, and it is not effective in terms of copper yield for the S content to be less than or equal to this.

(2) The copper content in calcium ferrite slag is mainly oxide which is chemically dissolved, and even with slow cooling, the copper recovery rate by concentration is low.

(3) As aforementioned, when the $SiO_2$ of calcium ferrite slag reaches approximately 1 to 3%, the viscosity increases considerably and foaming occurs. Therefore, it is difficult to use matte containing iron silicate slag as raw material. When the Fe content of matte is 10%, the $SiO_2$ allowed to mix into the matte is 0.2% or less with respect to the matte, and it is necessary to pay special attention to avoid the slag mixing into the matte produced in the matte smelting process.

(4) Since Pb solubility is low, Pb is difficult to distribute into the slag, so that it becomes concentrated in the blister copper. It is therefore difficult to produce an anode capable of electrolysis from high Pb content raw material, with a conventional process.

(5) When compared at the same temperature, because its permeability in refractories is high, it causes greater erosion of refractories in the converter than silicate slag.

DISCLOSURE OF THE INVENTION

It is therefore an object of the present invention to provide a copper sulfide concentrate smelting process for producing white metal or blister copper with continuous oxidation of copper sulfide concentrate or matte, (1) at 1300° C. or less which is the normal temperature for copper smelting, without magnetite complications, (2) which is applicable for the treatment of copper sulfide concentrate or matte containing $SiO_2$, (3) with less loss of copper to slag, (4) capable of recovering copper content of slag by flotation, (5) with high removability of As, Sb and Pb into slag, and (6) with less erosion of refractories.

The method of the present invention is characterized in that, oxygen smelting is carried out to produce; slag in which a weight ratio of CaO to ($SiO_2$+CaO) is 0.3 to 0.6 and a weight ratio of Fe to (FeOx+$SiO_2$+CaO) is 0.2 to 0.5, and white metal, nearly white metal matte, or blister copper, by adding $SiO_2$ material and CaO material as flux to copper sulfide concentrate.

Furthermore, the method is characterized in that oxygen smelting is carried out to produce; slag with a ratio of CaO to ($SiO_2$+CaO) by weight of 0.3 to 0.6 and a ratio of Fe to (FeOx+$SiO_2$+CaO) by weight of 0.2 to 0.5, and blister copper, by adding $SiO_2$ material and CaO material to the matte obtained by smelting the copper sulfide concentrate.

BEST MODE FOR CARRYING OUT THE INVENTION

Table 1 shows the characteristics of slag under the condition of high oxygen partial pressure to produce white metal or blister copper, comparing iron silicate slag used in conventional copper smelting, calcium ferrite slag used in the Mitsubishi method, and iron calcium silicate slag used in the present invention.

TABLE 1

| | Iron silicate slag | Calcium ferrite slag | Iron calcium silicate slag |
|---|---|---|---|
| Low viscosity | X | O | O |
| Low suspension of matte and blister copper | X | O | O |
| Low oxidation and dissolution of copper | X | X | O |
| Low sulfurization and dissolution of copper | O | X | X |
| High Pb solubility | O | X | O |
| Solubility of As and Sb | X | O | O |
| Magnetite solubility | X | O | O |
| Less erosion of refractories | O | X | O |

Heretofore, viscosity has been improved by adding some CaO to iron silicate slag. In a matte smelting process, however, when the CaO content increases, since the copper solubility as sulfide increases and also the amount of slag increases, it is considered to be a disadvantage. However, provided that white metal or blister copper, which has no problem of sulirization, is present, oxidation and dissolution of copper increases considerably with iron silicate slag or calcium ferrite slag, while with iron calcium silicate slag used for the present invention, oxidation and dissolution of copper is low, so that when evaluating with the equation that slag amount x copper content=copper loss by oxidizing and dissolution, the loss is found to be less than with the conventional methods (high MG matte smelting method using iron silicate slag or calcium ferrite slag, white metal smelting, and direct copper smelting), and hence the present invention was proposed.

Figure 1:
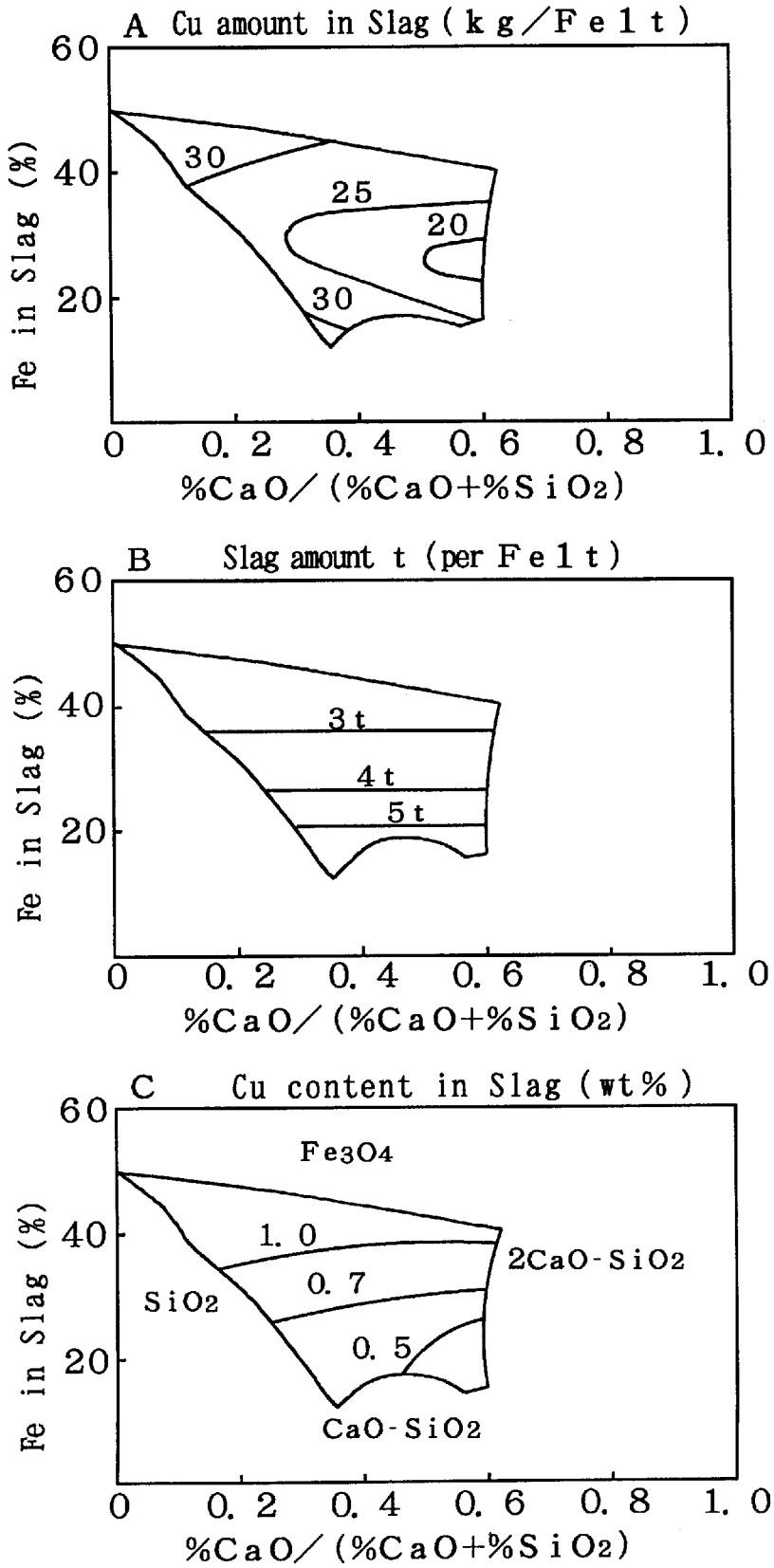
FIG. 1 contains graphs showing the copper amount in the slag (A), the weight of the slag produced (B) and the copper content of the slag (C) at 1300° C. with respect to the ratio of CaO to ($SiO_2$+CaO) (horizontal axis) and Fe % (vertical axis) in the case of obtaining matte of MG 75 by oxidizing copper sulfide concentrate.

FIG. 1 contains graphs showing the copper amount of the slag (A), the weight of the slag produced (B) and the copper content of the slag (C) at 130° C. with respect to the weight ratio of CaO to ($SiO_2$+CaO) (horizontal axis) and Fe % (vertical axis) in the case of obtaining matte of MG 75 by oxidizing copper sulfide concentrate. Each graph shows the saturation line of each solid phase, and when the weight ratio of CaO to ($SiO_2$+CaO) is 0.6 or more, $2CaO \cdot SiO_2$ is precipitated. Furthermore, if the Fe content is too high, magnetite is precipitated. The left side of the graph corresponds to conventional iron silicate slag (CaO=0%).

There is a tendency that the lower the iron content of the slag becomes, the lower the copper content becomes, and the greater the weight ratio of CaO to ($SiO_2$+CaO), the lower the copper content. Since the amount of slag produced depends on the iron content of the slag, and the amount of iron to be removed depends on the raw material, the higher the iron content of the slag is the less the slag amount becomes. The amount of copper transferred to the slag (amount of loss) is determined by the amount of slag x copper content of the slag, and, as is shown in the top graph, the lowest value is around the composition of the weight ratio of CaO to ($SiO_2$+CaO) being 0.5 to 0.6, and the weight ratio of Fe to (FeOx+$SiO_2$+CaO) being 0.2 to 0.5. That is to say, from the point of minimizing the loss of copper into the slag, slag of around this composition should be chosen.

Figure 2:
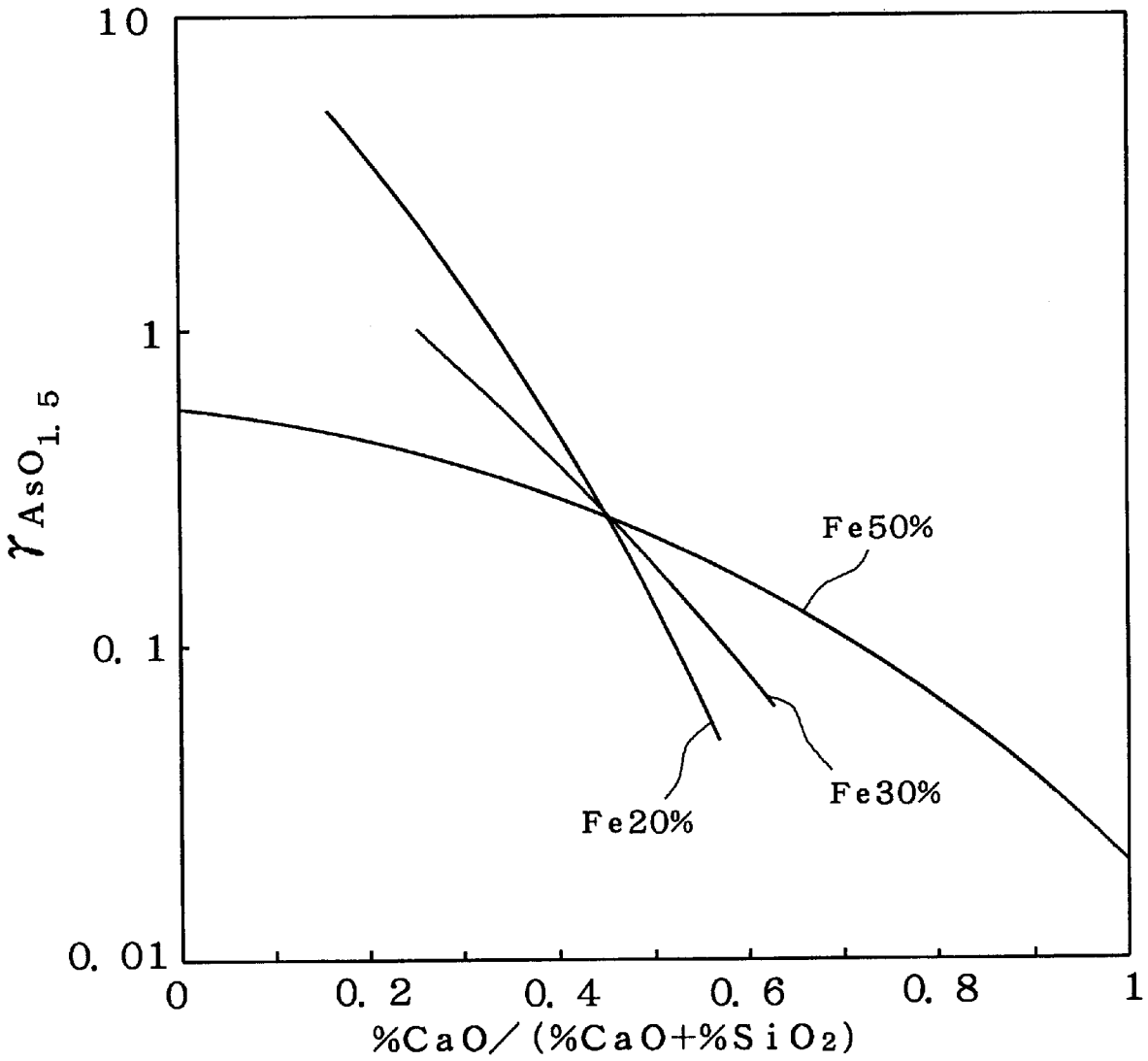
FIG. 2 is a graph showing As activity factor in the slag with respect to the slag composition.

On the other hand, FIG. 2 is a graph showing the As activity factor of the slag with respect to the slag composition. The horizontal axis shows the weight ratio of CaO to ($SiO_2$+CaO), and the vertical axis the As activity factor ($\gamma_{AsO1.5}$). The left side of the graph corresponds to conventional iron silicate slag, the right side to calcium ferrite slag, and iron calcium silicate slag that the present invention uses is located in the middle of the two. The activity factor shows that the smaller the value is, the easier the element is to remove into slag.

FIG. 2 indicates that if the weight ratio of CaO to ($SiO_2$+CaO) is 0.3 or more, then the eliminating capacity of As becomes higher than iron silicate slag. Furthermore Sb, which belongs to the same V group as As, also shows similar behavior.

Figure 3:
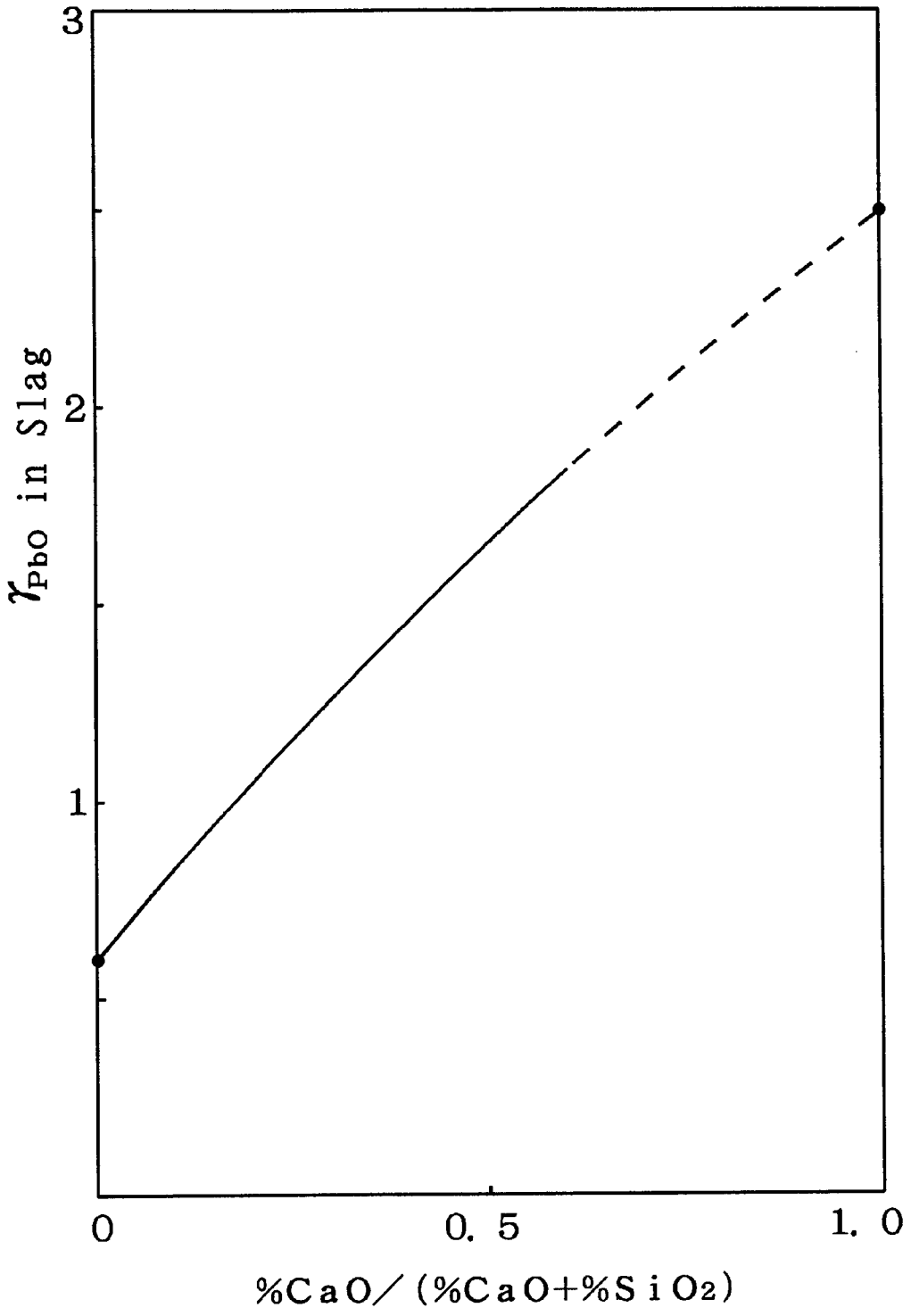
FIG. 3 is a graph showing Pb activity factor in the slag with respect to the slag composition.

On the other hand, as shown in FIG. 3, Pb shows the opposite behavior, and the activity factor ($\gamma_{PbO}$) is extremely large with calcium ferrite slag, and the smaller the weight ratio of CaO to ($SiO_2$+CaO) is, the smaller the value it shows. While the eliminating capacity of Pb is a little lower than iron silicate slag when the weight ratio of CaO to ($SiO_2$+CaO) is 0.3 to 0.6, it has a relatively higher eliminating capacity than calcium ferrite slag.

The above result shows that elimination of any one of As, Sb and Pb into the slag becomes easy when the weight ratio of CaO to ($SiO_2$+CaO) is 0.3 to 0.6.

Figure 4:
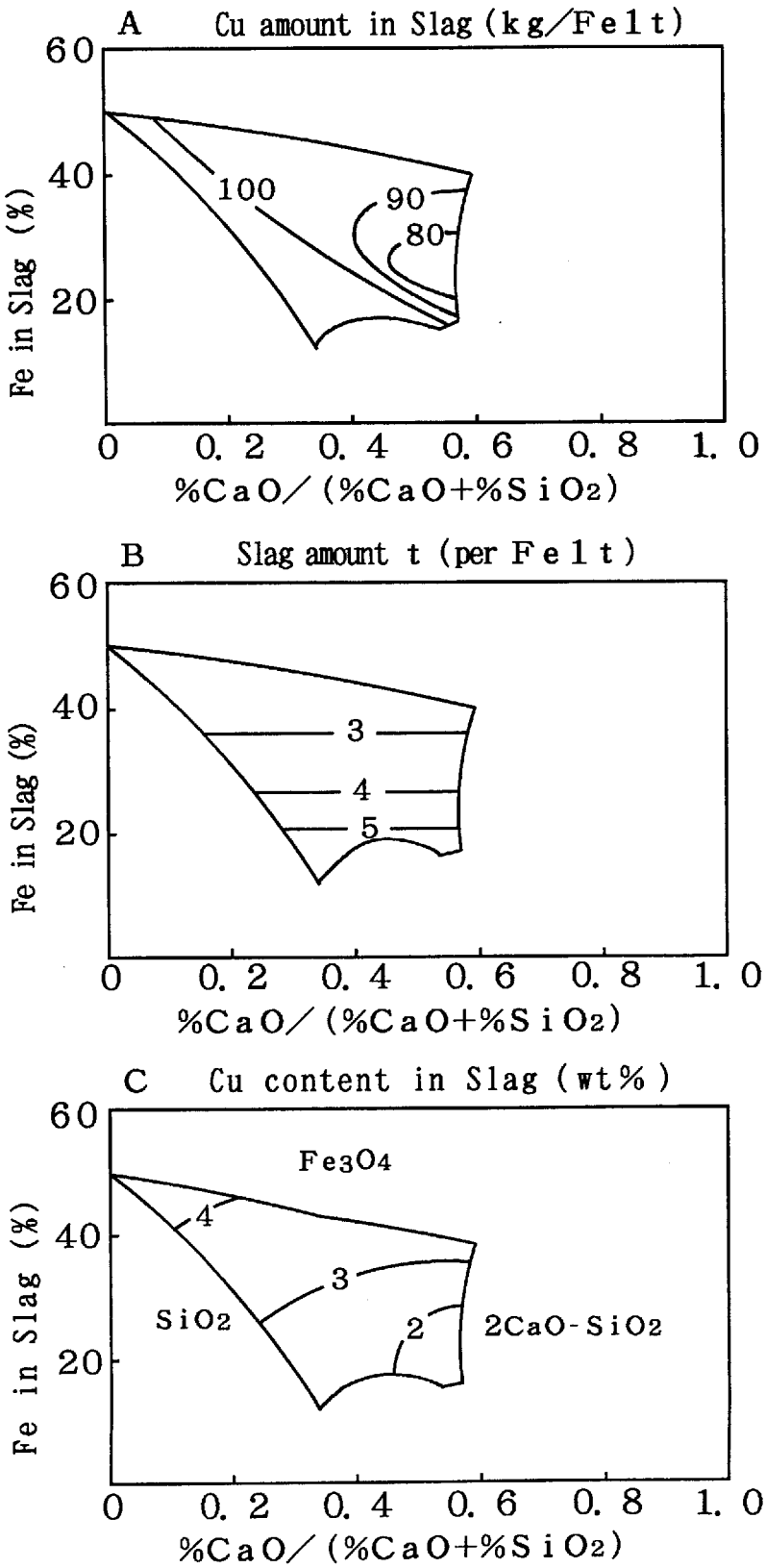
FIG. 4 is a graph showing the copper amount in the slag (A), the weight of the slag produced (B) and the copper content of the slag (C) at 1300° C. with respect to the ratio of CaO to ($SiO_2$+CaO) (horizontal axis) and Fe % (vertical axis) in the case of obtaining blister copper of about 1 to 1.5% of S in the presence of white metal.

FIG. 4 shows a similar relationship to FIG. 1 in the case of obtaining blister copper with an S content of approximately 1 to 1.5% in the presence of white metal. The left side of the graph corresponds to iron silicate slag (CaO 0%), and the right side to calcium ferrite slag ($SiO_2$=0%). The top graph indicates that copper loss is lowest near to the saturation line of $2CaO \cdot SiO_2$. With calcium ferrite slag, copper loss is also comparatively small, however, when a little $SiO_2$ is charged, it causes $2CaO \cdot SiO_2$ saturation and creates a problem of slag foaming.

Regarding the distribution of impurities, it has the same tendency as with matte smelting. While there is a weak point in that it is difficult for calcium ferrite slag to absorb Pb, and difficult for iron silicate slag to absorb As and Sb, any one of As, Sb and P becomes easy to be removed into the slag by making the weight ratio of CaO to ($SiO_2$+CaO) 0.3 to 0.6.

The above result shows that the optimum composition for minimizing copper loss and making it easy to eliminate any one of Pb, As and Sb is in the range of the weight ratio of CaO to ($SiO_2$+CaO) being 0.3 to 0.6, and the weight ratio of Fe to (FeOx+$SiO_2$+CaO) being 0.2 to 0.5.

Figure 5:
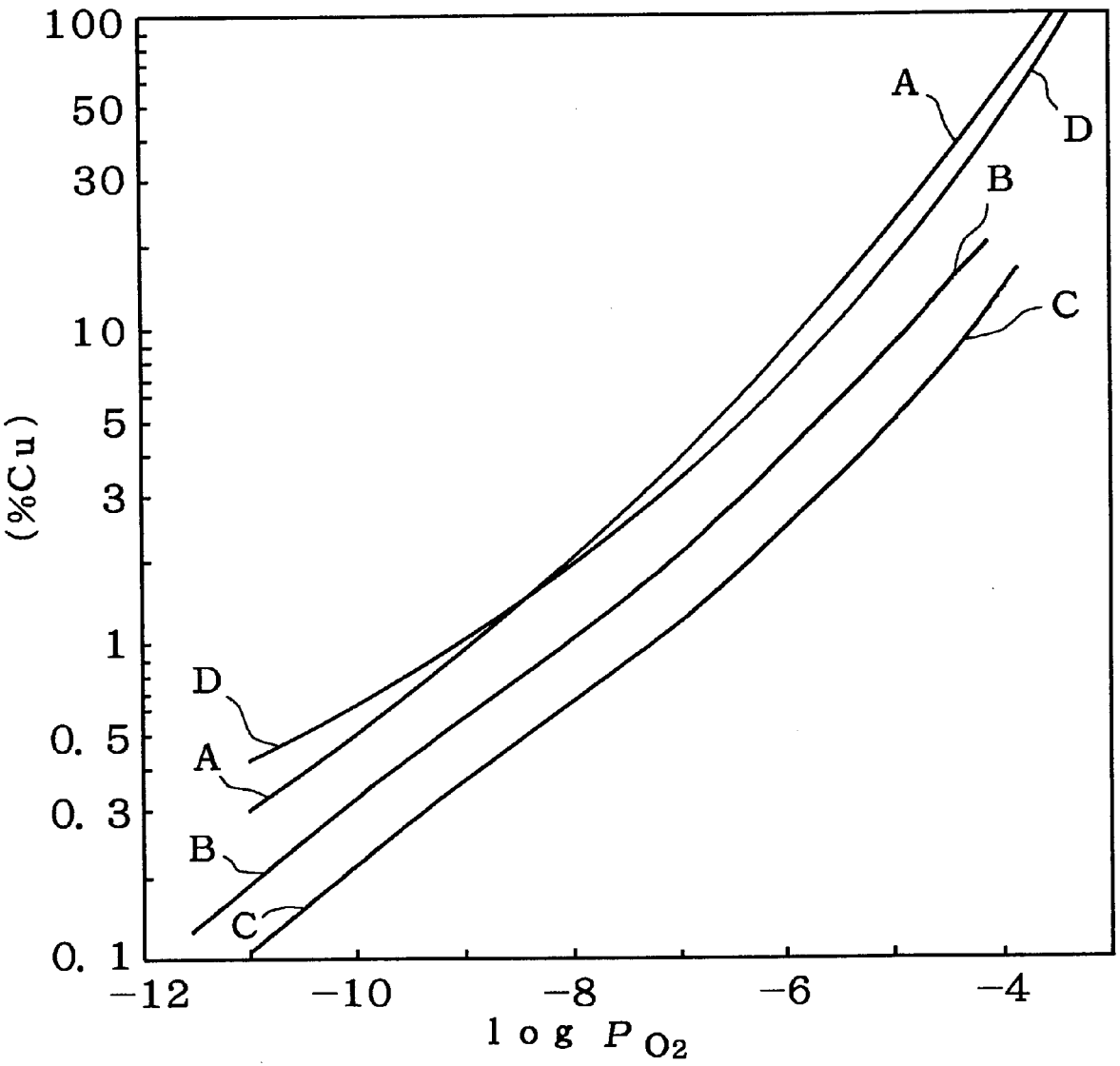
FIG. 5 is a graph showing the relationship between the concentration of the copper oxidized and dissolved in the slag and the oxygen partial pressure in the presence of molten copper at 1573K.

FIG. 5 shows the copper content of the slag with respect to oxygen partial pressure, showing the behavior when attempting to obtain low S content blister copper in the region of higher oxidation degree than the case shown in FIG. 4. In the graph, Curve A shows iron silicate slag, Curve D calcium ferrite slag, and Curves B and C iron calcium silicate slag that the present invention uses. With iron silicate slag and calcium ferrite slag, the copper of the slag changes continuously up to 100% corresponding to the climb of oxygen partial pressure. On the other hand with iron calcium silicate slag, since copper oxide saturates at a copper content of approximately 20%, the copper content of the slag does not exceed this level. That is to say, if blister copper is produced under this condition, blister copper of 0.01% or less S content (blister copper with saturated copper oxide) can be produced with the copper content of the slag being about 20%. If blister copper with a similar level of oxidation is produced with iron silicate slag or calcium ferrite slag, the copper content of the slag becomes so high that it is not practical for use in terms of yield.

Regarding the erosion of refractories, the permeation of slag components into the refractories is considered to have a great effect thereon. Normally it is known that in the case when slag components permeate into magnesite-chrome refractories used for copper smelting, iron oxide in the slag is absorbed into periclase (MgO) or spinel containing $Cr_2O_3$. In the case of slag that contains $SiO_2$, when it infiltrates into refractories, iron oxide is absorbed in periclase (MgO) or spinel for solid solution, and subsequently the $SiO_2$ concentration of the slag increases. As a result, the viscosity of the slag increases, and further permeation of the slag is considered to be restricted.

Examples will now be explained hereinafter.

EXAMPLE 1

In a magnesia crucible maintained at 1300° C., 40 g molten matte and 60 g molten slag as shown in Table 2 were prepared, and copper sulfide concentrate of the composition similarly shown in Table 2, $SiO_2$ (95% or more pure $SiO_2$ content) and CaO (98% or more pure CaO content) were blown into the molten bath through a lance pipe along with 95% $O_2$—5% $N_2$ (volume %) without dipping the lance pipe in.

TABLE 2

| | (wt %) | | | | |
|---|---|---|---|---|---|
| | Cu | Fe | S | $SiO_2$ | CaO |
| Molten matte | 74.8 | 2.0 | 20.5 | — | — |
| Molten slag | 2.4 | 35.1 | — | 22.9 | 16.2 |
| Copper sulfide concentrate | 31.4 | 24.0 | 30.2 | 6.9 | — |

The lance pipe used for blowing was made of alumina, through which 20 g/min of copper sulfide concentrate, 1.94 g/min of $SiO_2$ and 2.20 g/min of CaO were blown along with 4.5 liter/min of 95% $O_2$—5% $N_2$ (volume %) gas.

Under the conditions described above, the blowing was carried out continuously for 50 minutes, and after being discontinued for 10 minutes, cooling and solidification followed. Subsequently the weights and compositions of the matte and slag were measured, and then by subtracting the amount of each element from the amounts and compositions of the matte and slag originally charged, the amounts and compositions of matte and slag produced by the reaction were calculated. The results are shown in Table 3.

TABLE 3

| | (wt %) | | | | | |
|---|---|---|---|---|---|---|
| | Yield weight (g) | Cu | Fe | S | $SiO_2$ | CaO |
| Producedmatte | 375 | 76.2 | 1.0 | 20.1 | — | — |
| Produced slag | 641 | 1.9 | 35.0 | — | 23.8 | 16.0 |

EXAMPLE 2

In a magnesia crucible maintained at 1300° C., 30 g molten blister copper and 80 g molten slag of the compositions shown in Table 4 were prepared, and copper sulfide concentrate of the composition similarly shown in Table 4, $SiO_2$ (95% or more pure $SiO_2$ content) and CaO (98% or more pure CaO content) were blown into the molten bath through a lance pipe along with 95% $O_2$—5% $N_2$ (volume %) without dipping the lance pipe in.

TABLE 4

| | (wt %) | | | | |
|---|---|---|---|---|---|
| | Cu | Fe | S | $SiO_2$ | CaO |
| Molten blister copper | 97.5 | — | 1.2 | — | — |
| Molten slag | 3.8 | 31.0 | — | 26.1 | 18.2 |
| Copper sulfide concentrate | 31.4 | 24.0 | 30.2 | 6.9 | — |

The lance pipe used for blowing was made of alumina, through which 20 g/min of copper sulfide concentrate, 3.02 g/min of $SiO_2$ and 2.88 g/min of CaO were blown along with 5.8 liter/min of 95% $O_2$—5% $N_2$ (volume %) gas.

Under the conditions described above, the blowing was carried out continuously for 50 minutes, and after being discontinued for 10 minutes, cooling and solidification followed. Subsequently the weights and compositions of the blister copper and the slag were measured, and then by subtracting the amount of each element from the amounts and compositions of the blister copper and slag originally charged, the amounts and compositions of blister copper and slag produced by the reaction were calculated. The results are shown in Table 5.

TABLE 5

| | (wt %) | | | | | |
|---|---|---|---|---|---|---|
| | Yield weight (g) | Cu | Fe | S | $SiO_2$ | CaO |
| Produced blister copper | 273 | 98.1 | — | 0.99 | — | — |
| Produced slag | 764 | 4.2 | 29.8 | — | 26.3 | 17.9 |

EXAMPLE 3

In a magnesia crucible maintained at 1300° C., 60 g molten blister copper and 40 g molten slag of the compositions shown in Table 6 were prepared, and matte of the composition similarly shown in Table 6, $SiO_2$ (95% or more pure $SiO_2$ content) and CaO (98% or more pure CaO content) were blown into the molten bath through a lance pipe along with 95% $O_2$—5% $N_2$ (volume %) without dipping the lance pipe in.

TABLE 6

| | (wt %) | | | | |
|---|---|---|---|---|---|
| | Cu | Fe | S | $SiO_2$ | CaO |
| Molten blister copper | 97.5 | — | 1.2 | — | — |
| Molten slag | 18.4 | 25.3 | — | 22.1 | 13.5 |
| Matte | 65.3 | 9.7 | 21.4 | — | — |

The lance pipe used for blowing was made of alumina, through which 20 g/min of copper sulfide concentrate, 1.78 g/min of $SiO_2$ and 1.14 g/min of CaO were blown along with 4.0 liter/min of 95% $O_2$—5% $N_2$ (volume %) gas.

Under the conditions described above, the blowing was carried out continuously for 50 minutes, and after being discontinued for 10 minutes, cooling and solidification followed. Subsequently the weights and composition of the blister copper and the slag were measured, and then by subtracting the amount of each element from the amounts and compositions of the blister copper and slag originally charged, the amounts and compositions of blister copper and slag produced by the reaction were calculated. The results are shown in Table 7.

TABLE 7

| | (wt %) | | | | | |
|---|---|---|---|---|---|---|
| | Yield weight (g) | Cu | Fe | S | $SiO_2$ | CaO |
| Produced copper | 558 | 98.8 | — | 0.05 | — | — |
| Produced slag | 382 | 20.6 | 24.9 | — | 20.8 | 14.0 |

In the tests of Examples 1 through 3, the dust occurrence rate was in the range of 4 to 7% by weight. During these processes there were no complications caused by the occurrence of magnetite.

EXAMPLE 4

A flotation test was carried out using a test flotation machine, in which the slag produced in Example 3 was finely pulverized in a ball mill until 95% was under 200 mesh, and 200 g of this slag was made into 65% slurry by weight with water. At this time 0.02 g of pine oil was added as a foaming agent, plus 0.006 g, 0.01 g and 0.03 g respectively of commercially available DM-2000, MCB-4 and xanthate added as flotation reagents.

The result of the test is shown in Table 8. It was confirmed that 80% or more copper was able to be recovered by the flotation.

TABLE 8

| Ore | Concentrate | | Tailing | |
|---|---|---|---|---|
| Cu % | Cu % | Distribution | Cu % | Distribution |
| 20.8 | 38 | 81 | 1.5 | 19 |

EXAMPLE 5

With a small autogeneous smelting furnace, in which the inside diameter of the reaction tower was 1.5 m, the height thereof 3.5 m, the inside diameter of the settler portion 1.5 m, the length thereof 5.2 m, copper sulfide concentrate, silica rock powder and lime powder (each pulverized to 200 μm of less) the compositions of which are shown in Table 9, were mixed at a predetermined ratio, dried (hereinafter called dried concentrate) and blown into the reaction tower through a concentrate burner fixed on the ceiling of the reaction tower, along with oxygen-enriched air of 50% oxygen to obtain slag and matte. A concentrate burner, in which a heavy oil burner was installed, controlled the amount of heavy oil such that heat balance in the reaction tower was maintained. The operation was carried out for 4 days. The obtained result is shown in Table 9. Table 9 indicates that a high-grade matte of MG of about 76 was obtained consistently.

TABLE 9

| | Amount (kg/h) | (wt %) Cu | Fe | S | $SiO_2$ | CaO |
|---|---|---|---|---|---|---|
| Process Copper | 1040 | 31.4 | 25.1 | 30.2 | 6.9 | — |
| Silica rock | 104 | — | 2 | — | 95 | |
| Limestone | 208 | — | — | — | — | 53 |
| Product Molten matte | 382 | 76.8 | 1.0 | 20.1 | — | — |
| Molten slag | 700 | 2.5 | 35.0 | — | 24.2 | 16.1 |

Concentrate burner blast air amount 580 $Nm^3/h$, Oxygen concentration 50%

Heavy oil amount 53 liter/h

Produced slag average temperature 1258° C.,

Produced matte average temperature 1146° C.

COMPARATIVE EXAMPLE 1

In a magnesia crucible maintained at 1300° C., 30 g molten matte and 40 g molten slag of the compositions shown in Table 10 were prepared, and copper sulfide concentrate of the composition similarly shown in Table 10 and $SiO_2$ (97% or more pure $SiO_2$ content) were blown into the molten bath through a lance pipe along with 95% $O_2$—5% $N_2$ (volume %) without dipping the lance pipe in.

TABLE 10

| | (wt %) Cu | Fe | S | $SiO_2$ | CaO |
|---|---|---|---|---|---|
| Molten matte | 76.3 | 2.8 | 20.8 | — | — |
| Molten slag | 5.0 | 42.0 | — | 30.0 | — |
| Copper sulfide concentrate | 30.3 | 29.1 | 33.5 | 1.8 | — |

The lance pipe used for blowing was made of alumina, through which 37.5 g/min of copper sulfide concentrate, 7.6 g/min of $SiO_2$ were blown along with 9.2 liter/min of 95% $O_2$—5% $N_2$ (volume %) gas.

Five minutes after the test started, blowing to the formation of a high melting point substance, being a mixture of matte and produced magnetite, it was impossible to blow the raw material to be supplied into the melt, and furthermore, these substances blocked the lance pipe, and the test could not be continued.

COMPARATIVE EXAMPLE 2

In a magnesia crucible maintained at 1300° C., 60 g molten blister copper and 40 g molten slag of the compositions shown in Table 11 were prepared, and matte of the composition similarly shown in Table 11 and CaO (98% or more pure CaO content) were blown into the molten bath through a lance pipe along with 95% $O_2$—5% $N_2$ (volume %) without dipping the lance pipe in.

TABLE 11

| | (wt %) Cu | Fe | S | $SiO_2$ | CaO |
|---|---|---|---|---|---|
| Molten blister copper | 97.5 | — | 1.2 | — | — |
| Molten slag | 16.4 | 47.6 | — | — | 17.6 |
| Matte | 64.0 | 9.5 | 21.0 | 2.0 | — |

The lance pipe used for blowing was made of alumina, through which 20 g/min of matte and 0.73 g/min of CaO were blown along with 0.20 liter/min of 95% $O_2$—5% $N_2$ (volume %) gas.

Thirty minutes after the test started, a boiling phenomenon of the slag occurred, so that most of the melt in the crucible blew out of the crucible and the test could not be continued.

COMPARATIVE EXAMPLE 3

In a magnesia crucible maintained at 1300° C., 60 g molten blister copper and 40 g molten slag of the compositions shown in Table 12 were prepared, and matte of the composition similarly shown in Table 12 and CaO (98% or more pure CaO content) were blown into the molten bath through a lance pipe along with 95% $O_2$—5% $N_2$ (volume %) without dipping the lance pipe in.

TABLE 12

| | (wt %) Cu | Fe | S | $SiO_2$ | CaO |
|---|---|---|---|---|---|
| Molten blister copper | 97.5 | — | 1.2 | — | — |
| Molten slag | 16.4 | 47.6 | — | — | 15.7 |
| Matte | 65.3 | 9.7 | 21.4 | — | — |

The lance pipe used for blowing was made of alumina, through which 20 g/min of matte and 0.7 g/min of CaO were blown along with 4.2 liter/min of 95% $O_2$—5% $N_2$ (volume %) gas.

With the above described condition, the blowing was continuously carried out for 50 minutes, and after being discontinued for 10 minutes, cooling and solidification followed, and the weights and compositions of the blister copper and the slag were measured. Then by subtracting the amount of each composition from the amounts and compositions of the blister copper and the slag originally charged, the amounts and compositions of blister copper and slag produced by the reaction were calculated. The results are shown in Table 13.

While 0.06% S content of the blister copper was obtained, the copper content of the slag was high and the blister copper yield was about 80%.

TABLE 13

| | (wt %) | | | | | |
|---|---|---|---|---|---|---|
| | Yield weight (g) | Cu | Fe | S | $SiO_2$ | CaO |
| Produced blister copper | 534 | 98.3 | — | 0.06 | — | — |
| Produced slag | 290 | 32.7 | 32.0 | — | — | 11.2 |

COMPARATIVE EXAMPLE 4

A flotation test was carried out using a test flotation machine, in which calcium ferrite slag containing 16.4% Cu, 47.6% Fe and 15.7% CaO was finely pulverized in a ball mill until 95% was under 200 mesh, and 200 g of this slag was made into 65% slurry by weight with water. At this time 0.02 g of pine oil was added as a foaming agent, plus 0.006 g, 0.01 g and 0.03 g respectively of commercially available DM-2000, MCB-4 and xanthate added as flotation reagents.

The result of the test is shown in Table 14. It was difficult to recover copper from calcium ferrite slag by the flotation.

TABLE 14

| Ore | Concentrate | | Tailing | |
|---|---|---|---|---|
| Cu % | Cu % | Distribution | Cu % | Distribution |
| 16.4 | 21 | 54 | 10 | 46 |

INDUSTRIAL APPLICABILITY

The method of the present invention, when copper sulfide concentrate or matte is oxidized continuously to produce white metal or blister copper, enables the smelting of copper sulfide concentrate which, without magnetite complications, is applicable for the treatment of copper sulfide concentrate or matte containing $SiO_2$, has less copper loss to slag, can recover copper from the slag by flotation, has high removability of As, Sb and Pb into slag, and has less damage to refractories.

What is claimed is:

1. A method of smelting copper sulfide concentrate containing Cu, Fe, S and O components to obtain at least one of white metal, nearly white metal matte and blister copper, the white metal substantially being $Cu_2S$, the nearly white metal matte having a copper content closer to the white metal, the method comprising adding $SiO_2$ material and CaO material and oxygen into the copper sulfide concentrate for oxygen-smelting to produce a slag containing CaO $SiO_2$, $FeO_x$, and Fe, a gas containing $SO_2$, and the at least one of white metal, nearly white metal matte and blister copper, such that the slag has a composition in which a weight ratio of CaO to ($SiO_2$+CaO) is 0.3 to 0.6 and a weight ratio of Fe to ($FeO_x$+$SiO_2$+CaO) is 0.2 to 0.5, wherein most of the Fe component in the copper sulfide concentrate is removed into the slag while part or most of the S component therein is removed as the $SO_2$.

2. A method of smelting copper sulfide concentrate according to claim 1, wherein the produced slag is slowly cooled and solidified and then subjected to pulverizing and flotation, and the recovered copper content is again subjected to the oxygen smelting process.

3. A method of smelting copper sulfide concentrate according to claim 1, wherein the $SiO_2$ content of the copper sulfide concentrate is at least 1.7% by weight with respect to the Fe to be removed in the slag.

4. A method of smelting copper sulfide concentrate according to claim 1, wherein the temperature of the produced slag is maintained up to 1300° C.

5. A method of smelting copper sulfide concentrate containing Cu, Fe, S and O components to obtain a blister copper the method comprising adding $SiO_2$ material and CaO material and oxygen into the copper sulfide concentrate for oxygen-smelting to produce a slag, a gas containing $SO_2$, and a matte substantially being a mixture of FeS and $Cu_2S$, wherein part of the Fe component in the copper sulfide concentrate is removed into the slag while part of the S component therein is removed as the $SO_2$, and adding $SiO_2$ material and CaO material and oxygen into the matte for oxygen-smelting to produce a slag containing CaO, $SiO_2$, $FeO_2$, and Fe, a gas containing $SO_2$, and the blister copper such that the slag has a composition in which a weight ratio of CaO to ($SiO_2$+CaO) is 0.3 to 0.6 and a weight ratio of Fe to ($FeO_x$+$SiO_2$+CaO) is 0.2 to 0.5, wherein most of the Fe component in the copper sulfide concentrate is removed into the slag while most of the S component therein is removed as the $SO_2$.

6. A method of smelting copper sulfide concentrate according to claim 5, wherein the produced slag is slowly cooled and solidified and then subjected to pulverizing and flotation, and the recovered copper content is again subjected to the matte oxygen smelting process.

7. A method of smelting copper sulfide concentrate according to claim 5, wherein the produced slag is maintained in a molten condition and again subjected to the matte oxygen-smelting process.

8. A method of smelting copper sulfide concentrate according to claim 5, wherein the produced slag is cooled and solidified and then again subjected to the matte oxygen-smelting process.

9. A method of smelting copper sulfide concentrate according to claim 5, wherein the $SiO_2$ content in the matte is at least 1.7% by weight with respect to the Fe to be removed in the slag.

10. A method of smelting copper sulfide concentrate according to claim 5, wherein the temperature of the produced slag is maintained up to 1300° C.

* * * * *